US011061344B2

(12) United States Patent
Sawada et al.

(10) Patent No.: US 11,061,344 B2
(45) Date of Patent: Jul. 13, 2021

(54) TONER, TONER STORED UNIT, IMAGE FORMING APPARATUS, AND IMAGE FORMING METHOD

(71) Applicants: Toyoshi Sawada, Shizuoka (JP); Kazumi Suzuki, Shizuoka (JP); Natsuko Matsushita, Shizuoka (JP); Yu Naito, Shizuoka (JP)

(72) Inventors: Toyoshi Sawada, Shizuoka (JP); Kazumi Suzuki, Shizuoka (JP); Natsuko Matsushita, Shizuoka (JP); Yu Naito, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 34 days.

(21) Appl. No.: 16/604,058

(22) PCT Filed: Apr. 6, 2018

(86) PCT No.: PCT/JP2018/014653
§ 371 (c)(1),
(2) Date: Oct. 9, 2019

(87) PCT Pub. No.: WO2018/190247
PCT Pub. Date: Oct. 18, 2018

(65) Prior Publication Data

US 2021/0018855 A1 Jan. 21, 2021

(30) Foreign Application Priority Data

Apr. 12, 2017 (JP) ..... JP2017-078710

(51) Int. Cl.
*G03G 9/08* (2006.01)
*G03G 9/09* (2006.01)
(Continued)

(52) U.S. Cl.
CPC ..... *G03G 9/0926* (2013.01); *G03G 9/08795* (2013.01); *G03G 9/09* (2013.01); *G03G 9/0906* (2013.01); *G03G 15/163* (2013.01)

(58) Field of Classification Search
CPC ..... G03G 9/0926; G03G 9/09; G03G 9/0906
(Continued)

(56) References Cited

U.S. PATENT DOCUMENTS 8,741,520 B2 6/2014 Sawada et al.
9,207,552 B2 12/2015 Matsushita et al.
(Continued)

FOREIGN PATENT DOCUMENTS

EP 2 214 057 A1 8/2010
JP 2-106762 A 4/1990
(Continued)

OTHER PUBLICATIONS

International Search Report dated Jun. 5, 2018 for counterpart International Patent Application No. PCT/JP2018/014653 filed Apr. 6, 2018.
(Continued)

*Primary Examiner* — Mark A Chapman
(74) *Attorney, Agent, or Firm* — Oblon, McClelland, Maier & Neustadt, L.L.P.

(57) ABSTRACT

Provided is a toner including a binder resin and a colorant, wherein the colorant includes Solvent Red 49, and an acid value of the toner is 9.0 mgKOH/g or greater but 30.0 mgKOH/g or less.

9 Claims, 1 Drawing Sheet

(51) Int. Cl.
*G03G 9/087* (2006.01)
*G03G 15/16* (2006.01)

(58) Field of Classification Search
USPC ..... 430/123.5, 108.1
See application file for complete search history.

(56) References Cited

U.S. PATENT DOCUMENTS

| | | | | |
|---|---|---|---|---|
| 9,348,245 | B2 | 5/2016 | Morita et al. | |
| 9,442,403 | B2 | 9/2016 | Miyaake et al. | |
| 9,482,975 | B2 | 11/2016 | Yamauchi et al. | |
| 9,606,464 | B2 | 3/2017 | Yamauchi et al. | |
| 9,785,075 | B2 | 10/2017 | Nakayama et al. | |
| 9,804,515 | B2 | 10/2017 | Sugiura et al. | |
| 9,851,649 | B2 | 12/2017 | Makabe et al. | |
| 2002/0132177 | A1 | 9/2002 | Sawada et al. | |
| 2003/0129518 | A1 | 7/2003 | Sawada et al. | |
| 2003/0219670 | A1 | 11/2003 | Sawada et al. | |
| 2005/0250037 | A1 | 11/2005 | Sawada et al. | |
| 2005/0277046 | A1 | 12/2005 | Sawada et al. | |
| 2007/0218386 | A1 | 9/2007 | Suzuki et al. | |
| 2008/0076055 | A1 | 3/2008 | Sawada et al. | |
| 2009/0042118 | A1 | 2/2009 | Suzuki et al. | |
| 2009/0142093 | A1 | 6/2009 | Sawada et al. | |
| 2009/0142094 | A1 | 6/2009 | Sawada et al. | |
| 2010/0189964 | A1 | 7/2010 | Kitagawa | |
| 2011/0086301 | A1 | 4/2011 | Cheng et al. | |
| 2011/0177447 | A1 | 7/2011 | Suzuki et al. | |
| 2012/0082926 | A1 | 4/2012 | Suzuki et al. | |
| 2012/0189955 | A1* | 7/2012 | Chen | G03G 9/08795 430/137.14 |
| 2013/0017480 | A1 | 1/2013 | Suzuki et al. | |
| 2013/0157183 | A1 | 6/2013 | Santo et al. | |
| 2013/0164665 | A1 | 6/2013 | Ishii et al. | |
| 2013/0236826 | A1 | 9/2013 | Makabe et al. | |
| 2013/0330522 | A1 | 12/2013 | Suzuki et al. | |
| 2014/0051019 | A1 | 2/2014 | Sekiguchi et al. | |
| 2014/0080047 | A1 | 3/2014 | Takahashi et al. | |
| 2014/0080051 | A1 | 3/2014 | Sawada et al. | |
| 2014/0113226 | A1 | 4/2014 | Ishii et al. | |
| 2014/0200326 | A1 | 7/2014 | Yamauchi et al. | |
| 2014/0272690 | A1 | 9/2014 | Suzuki et al. | |
| 2014/0272696 | A1 | 9/2014 | Yamashita et al. | |
| 2014/0272698 | A1 | 9/2014 | Yamada et al. | |
| 2015/0030819 | A1 | 1/2015 | Naito et al. | |
| 2015/0072287 | A1 | 3/2015 | Amemori et al. | |
| 2015/0212442 | A1 | 7/2015 | Ishii et al. | |
| 2015/0220009 | A1 | 8/2015 | Sato et al. | |
| 2015/0248074 | A1 | 9/2015 | Suzuki et al. | |
| 2015/0253685 | A1 | 9/2015 | Suzuki et al. | |
| 2015/0253688 | A1 | 9/2015 | Yamauchi et al. | |
| 2016/0223926 | A1 | 8/2016 | Miyaake et al. | |
| 2016/0327884 | A1 | 11/2016 | Nakajima et al. | |
| 2016/0363878 | A1 | 12/2016 | Hama et al. | |
| 2017/0139337 | A1 | 5/2017 | Kaneko et al. | |
| 2018/0067409 | A1 | 3/2018 | Yamauchi et al. | |
| 2018/0113391 | A1 | 4/2018 | Yamauchi et al. | |
| 2018/0173127 | A1* | 6/2018 | Moffat | G03G 9/08755 |
| 2018/0259864 | A1 | 9/2018 | Suzuki et al. | |
| 2018/0267418 | A1 | 9/2018 | Ogino et al. | |
| 2018/0329326 | A1 | 11/2018 | Matsushita et al. | |

FOREIGN PATENT DOCUMENTS

| | | | |
|---|---|---|---|
| JP | 2-293860 | A | 12/1990 |
| JP | 11-119472 | A | 4/1999 |
| JP | 2005-120367 | A | 5/2005 |
| JP | 2007-316467 | A | 12/2007 |
| JP | 2015-161887 | A | 9/2015 |
| JP | 2017-3990 | A | 1/2017 |

OTHER PUBLICATIONS

Written Opinion dated Jun. 5, 2018 for counterpart International Patent Application No. PCT/JP2018/014653 filed Apr. 6, 2018.
Japanese Office Action dated Feb. 24, 2021 in Japanese Patent Application No. 2017-078710, 2 pages.

* cited by examiner

[Fig. 1]
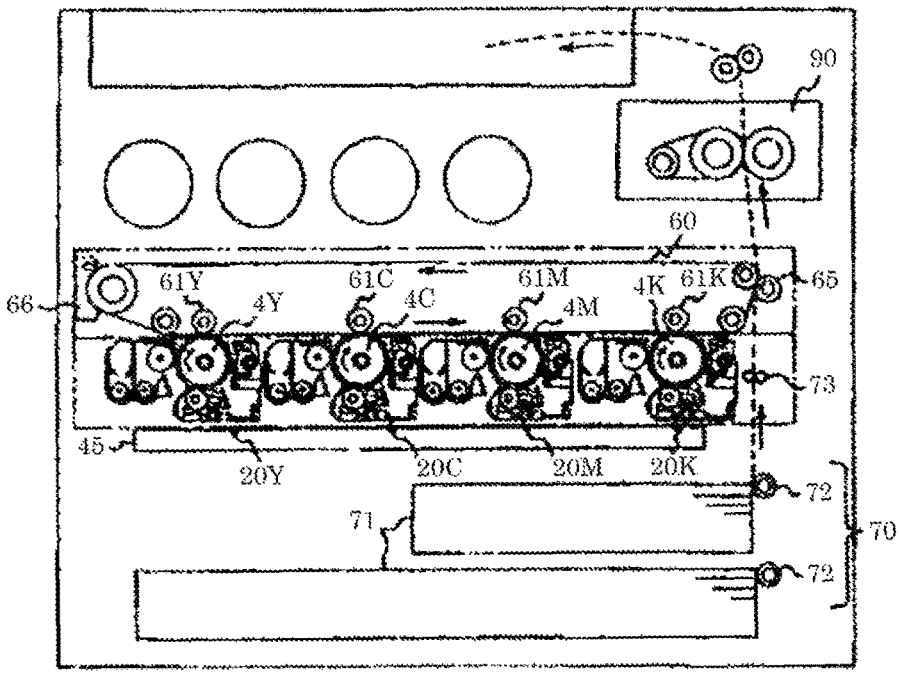
[Fig. 2]
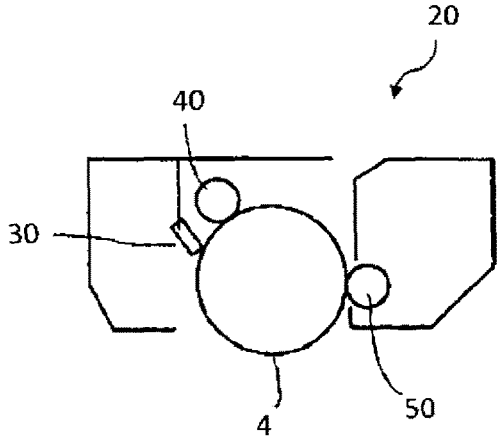
[Fig. 3]
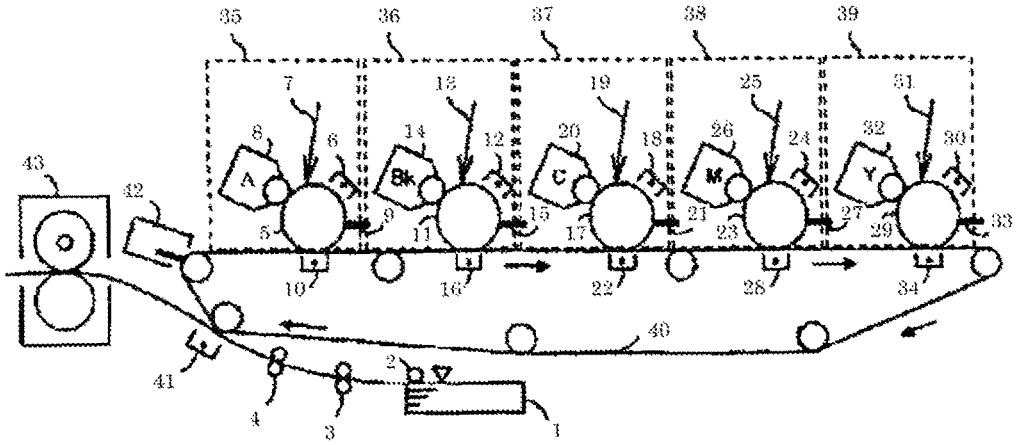

TONER, TONER STORED UNIT, IMAGE FORMING APPARATUS, AND IMAGE FORMING METHOD

TECHNICAL FIELD

The present disclosure relates to a toner, a toner stored unit, an image forming apparatus, and an image forming method.

Background Art

In order to form a full-color image according to an electrophotographic method, a toner set combining a cyan toner, a magenta toner, and a yellow toner, which are 3 process colors (may be simply referred to as process colors), with a black toner is typically used.

When a full-color image is formed, the order for developing toners is not particularly limited. For example, a full-color image is formed as follows. Light reflected from a document is applied to a photoconductor through a color-decomposing filter for exposure, or an image read by a scanner is written on the photoconductor with laser to thereby form an electrostatic latent image of a yellow image section on the photoconductor. The electrostatic latent image is developed with a yellow toner to obtain a yellow toner image. The obtained yellow toner image is transferred to a recording medium, such as paper. Subsequently, a magenta toner image, a cyan toner image, and a black toner image obtained by a process identical to the process above using a magenta toner, a cyan toner, and a black toner are sequentially superimposed on the yellow toner to thereby form a full-color image.

Since color image forming apparatuses of an electrophotographic method have recently become widely available, the color image forming apparatuses are used in various ways in various fields. Therefore, there are stronger demands for a high image quality. Especially in the field of design and advertisement, there is an increased need for colors that cannot be reproduced with a combination of process colors known in the art. Specifically, there is an increased need for fluorescent colors, such as fluorescent pink.

In order to respond to such demands, disclosed is a fluorescent aqueous ink whose fluorescent coloring ability is enhanced by using two fluorescent colorants in combination (see, for example, PTL 1).

CITATION LIST

Patent Literature

Japanese Unexamined Patent Application Publication No. 2005-120367

SUMMARY OF INVENTION

Technical Problem

The present disclosure has an object to provide a toner that can reproduce fluorescent pink having high fluorescence which cannot be reproduced with process colors in the art and that has excellent storage stability with resistance to high temperatures and high humidity.

Solution to Problem

According to one aspect of the present disclosure, a toner includes a binder resin and a colorant. The colorant includes Solvent Red 49. An acid value of the toner is 9.0 mgKOH/g or greater but 30.0 mgKOH/g or less.

Advantageous Effects of Invention

The present disclosure can provide a toner that can reproduce fluorescent pink having high fluorescence which cannot be reproduced with process colors in the art and that has excellent storage stability with resistance to high temperatures and high humidity.

BRIEF DESCRIPTION OF DRAWINGS

FIG. 1 is a schematic structural view illustrating one example of an image forming apparatus of the present disclosure.

FIG. 2 is a schematic view illustrating a structure of a main part of an example of the image forming apparatus of the present disclosure.

FIG. 3 is a schematic view illustrating a structure of another main part of an example of the image forming apparatus of the present disclosure.

DESCRIPTION OF EMBODIMENTS

Most of fluorescent colorants are dyes. In order to develop a fluorescent color with a toner, therefore, a colorant (dye) exhibiting a fluorescent color needs to be made compatible with a binder resin of a toner, which is different from a case of an aqueous ink as disclosed in PTL 1.

Toners known in the art have not achieved sufficient fluorescent coloring properties that meet demands in the market.

Accordingly, the present inventors diligently researched on a toner having high fluorescence, particularly a toner that can color fluorescent pink. As a result, the present inventors have found that a toner can color high fluorescent pink when a toner having a certain range of an acid value includes a colorant (dye) coloring a fluorescent color where the colorant includes Solvent Red 49, because Solvent Red 49 and the binder resin of the toner are sufficiently made compatible.

(Toner)

A toner of the present disclosure includes at least a binder resin and a colorant and may include a release agent and inorganic particles for internal addition. Moreover, the toner may further include other ingredients according to the necessity. The colorant includes Solvent Red 49.

An acid value of the toner is 9.0 mgKOH/g or greater but 30.0 mgKOH/g or less.

<Acid Value of Toner>

An acid value of the toner is 9.0 mgKOH/g or greater but 30.0 mgKOH/g or less.

The acid value of the toner is more preferably 9.0 mgKOH/g or greater but 27 mgKOH/g or less.

As a result of the researches of the present inventors, it has been found that compatibility between Solvent Red 49 and a binder resin largely varies depending on an acid value of the binder resin. It has been confirmed that, when the acid value of the toner is within the above-described range, Solvent Red 49 and the binder resin are sufficiently made compatible and desirable fluorescence can be obtained.

When the acid value of the toner is less than 9.0 mgKOH/g, fluorescent coloring of Solvent Red 49 is weak and fluorescence of a resultant image is low because a degree of compatibility between the binder resin of the toner and Solvent Red 49 is low. When the acid value is greater than 30.0 mgKOH/g, particles of the toner are aggregated with each other under high temperature and high humidity conditions and high-temperature and high-humidity resistant storage stability of the toner is degraded.

The acid value of the toner is nearly equal to an acid value of a binder resin that is a material occupying a large part of the toner. Therefore, the acid value of the toner may be adjusted by adjusting the acid value of the binder resin.

(Measurement of Acid Value of Toner)

An acid value of the toner can be measured according to the measurement method described in JIS K0070-1992 under the following conditions. Note that, an acid value of the binder resin can be also measured in the same manner.

Preparation of sample: To 120 mL of toluene, 0.5 g of a toner or a binder resin (0.3 g in case of an ethyl acetate-soluble component) is added. The resultant mixture is stirred for about 10 hours at room temperature (23 degrees Celsius) to dissolve the toner or binder resin. To the resultant, 30 mL of ethanol is further added to thereby prepare a sample solution.

As a measurement of the acid value, the acid value can be calculated by a device above. Specifically, the measurement is performed in the following manner. The sample solution is titrated with a pre-standardized N/10 potassium hydroxide/alcohol solution and the acid value is calculated from the consumed amount of the alcohol/potassium hydroxide using the following calculation.

Acid value=KOH (numerical value of mL)×N×56.1/mass of sample (where N is a factor of N/10 KOH)

<Colorant>

The colorant includes Solvent Red 49 as a colorant exhibiting fluorescent pink. In the present disclosure, moreover, the toner may further include a yellow pigment in addition to Solvent Red 49 in order to enhance fluorescence of the toner. Examples of the yellow pigment include Pigment Yellow 101.

Pigment Yellow 101 is the only pigment having fluorescence and is not compatible with a binder resin. Therefore, high-temperature and high-humidity resistant storage stability of a toner does not deteriorate even when fluorescence of the toner is obtained by adding Pigment Yellow 101 to the toner. On the other hand, Solvent Red 49 that is a dye can give fluorescence to a toner when Solvent Red 49 is compatible with a binder resin exhibiting a certain acid value. When an amount of Solvent Red 49 in a toner is large, however, high-temperature and high-humidity resistant storage stability of the toner may be low.

When a combination of Solvent Red 49 and Pigment Yellow 101 is included in a toner, characteristics of both colorants compensate with each other and hence both high fluorescence and high-temperature and high-humidity resistant storage stability can be obtained.

Solvent Red 49 absorbs light of from 250 nm through 270 nm and light of from 520 nm through 570 nm and emits fluorescence of from 580 nm through 640 nm. Meanwhile, Pigment Yellow 101 absorbs light of from 230 nm through 240 nm and light of from 470 nm through 500 nm and emits fluorescence of from 400 nm through 450 nm and fluorescence of from 500 nm through 600 nm.

When Solvent Red 49 and Pigment Yellow 101 are used in combination, therefore, both fluorescent colorants absorb excitation light to emit fluorescence without overlapping with each other in the ultraviolet region. Meanwhile, fluorescence of from 500 nm through 600 nm emitted from Pigment Yellow 101 is used as excitation light of Solvent Red 49. As a result, fluorescence of from 580 nm through 640 nm and of extremely high fluorescent intensity owing to Solvent Red 49 can be observed.

As an amount of the colorant in the toner of the present disclosure, an amount of Solvent Red 49 is preferably from 0.5 parts by mass through 2.0 parts by mass when a total amount of the binder resin and the release agent in the toner is 100 parts by mass (which can be read as the binder resin in the toner being 100 parts by mass in the case where the toner does not include the release agent).

When the amount of Solvent Red 49 is 0.5 parts by mass or greater, the following problem is effectively prevented. When fluorescent pink of a toner is pale, a deposition amount of the toner is increased to obtain desired coloring properties. As a result, there is a problem that image quality, such as granularity and reproducibility of fine lines is deteriorated. When the amount of Solvent Red 49 is 2.0 parts by mass or less, the following problem is effectively prevented. The problem is that charging properties of the toner become unstable and thermophysical properties of the toner is affected to lower fixing ability of the toner.

The amount of Solvent Red 49 is more preferably from 1.0 part by mass through 2.0 parts by mass.

Moreover, an amount of Pigment Yellow 101 is preferably from 0.1 parts by mass through 0.5 parts by mass when a total amount of the binder resin and the release agent in the toner is 100 parts by mass (which can be read as the binder resin in the toner being 100 parts by mass in the case where the toner does not include the release agent). When the amount of Pigment Yellow 101 is 0.1 parts by mass or greater, the following problem is effectively prevented. The problem is that an amplifying effect of a fluorescent intensity cannot be obtained and a sufficient fluorescence intensity cannot be obtained. When the amount of Pigment Yellow 101 is 0.5 parts by mass or less, moreover, a problem that a color of yellow in an image becomes too strong can be effectively prevented.

The amount of Pigment Yellow 101 is more preferably from 0.25 parts by mass through 0.5 parts by mass.

<Binder Resin>

In the present disclosure, the binder resin (resin for fixing) used as a toner material is not particularly limited and may be appropriately selected depending on the intended purpose. As the binder resin, any of resins known in the art can be used.

Examples of the binder resin include: styrene-based resin (homopolymers or copolymers including styrene or substituted styrene) such as styrene, polyalpha-methylstyrene, styrene-chlorostyrene copolymers, styrene-propylene copolymers, styrene-butadiene copolymers, styrene-vinyl chloride copolymers, styrene-vinyl acetate copolymers, styrene-maleic acid copolymers, styrene-acrylic acid ester copolymers, styrene-methacrylic acid ester copolymers, styrene-methyl alpha-chloroacrylate copolymers, and styrene-acrylonitrile-acrylic acid ester copolymers; epoxy resins; vinyl chloride resins; rosin-modified maleic acid resins; phenol resins; polyethylene resins; polypropylene resins; petroleum resins; polyurethane resins; ketone resins; ethylene-ethylacrylate copolymers; xylene resins; and polyvinyl butylate resins. Moreover, production methods of the above-listed resins are not particularly limited. Any of bulk polymerization, solution polymerization, emulsion polymerization, and suspension polymerization can be used.

In the present disclosure, a polyester resin is preferably included as the binder resin (resin for fixing). It is particularly more preferable that a polyester resin be a main component of the binder resin. Typically, the polyester resin can achieve low-temperature fixing with maintaining high-temperature and high-humidity resistant storage stability compared to other resins. Therefore, the polyester resin is a binder resin suitable for the present disclosure. The polyester resin for use in the present disclosure can be obtained through condensation polymerization between alcohol and carboxylic acid.

Examples of alcohol for use include: glycols, such as ethylene glycol, diethylene glycol, triethylene glycol, and propylene glycol; 1,4-bis(hydroxymethyl)cyclohexane; etherified bisphenols, such as bisphenol A; other divalent alcohol monomers; and trivalent or higher polyvalent alcohol monomers.

Moreover, examples of the carboxylic acid include: divalent organic acid monomers, such as maleic acid, fumaric acid, phthalic acid, isophthalic acid, terephthalic acid, succinic acid, and malonic acid; and trivalent or higher polyvalent carboxylic acid monomers, such as 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxypropane, and 1,2,7,8-octanetetracarboxylic acid.

Tg of the polyester resin is preferably from 50 degrees Celsius through 75 degrees Celsius.

Note that, the toner of the present disclosure preferably includes a resin having a chloroform-insoluble component in the binder resin. The resin having a chloroform-insoluble component is more preferably a polyester resin having a chloroform-insoluble component.

An acid value of the resin having a chloroform-insoluble component is preferably 20 mgKOH/g or greater but 40 mgKOH/g or less.

Compared to a resin that does not have a chloroform-insoluble component, the resin having a chloroform-insoluble component is unlikely to give a resultant toner poor high-temperature and high-humidity resistant storage stability when the resin having a chloroform-insoluble component is made compatible with Solvent Red 49, and the resin having a chloroform-insoluble component is unlikely to cause a problem that particles of the toner are aggregated with each other under high-temperature and high-humidity conditions.

When the acid value of the resin having a chloroform-insoluble component is 20 mgKOH/g or greater, the following problem can be effectively prevented. The problem is that fluorescent coloring of Solvent Red 49 is low due to low compatibility between the binder resin of the toner and Solvent Red 49 and hence fluorescence of a resultant image becomes low. When the acid value of the resin having a chloroform-insoluble component is 40 mgKOH/g or less, a problem that particles of the toner are aggregated with each other under high-temperature and high-humidity conditions can be effectively prevented.

In the present specification, the chloroform-insoluble component is an insoluble component obtained in the following manner. The binder resin is weighed by 1.0 g. To the binder resin, about 50 g of chloroform is added. The sufficiently dissolved solution is then separated by centrifugation and subjected to filtration with JIS standard (P3801) type-5 C qualitative filter paper. The residues on the filter paper is a chloroform-insoluble component <Properties of Toner><<Glass Transition Temperature Tg and Softening Temperature T(F½) of Toner>>

A glass transition temperature Tg and softening temperature T(F½) of the toner are preferably low as long as high-temperature and high-humidity resistant storage stability of the toner is not impaired. For example, Tg is preferably from 45 degrees Celsius through 75 degrees Celsius and more preferably from 50 degrees Celsius through 60 degrees Celsius. T(F½) is preferably from 90 degrees Celsius through 150 degrees Celsius and more preferably from 90 degrees Celsius through 130 degrees Celsius. When Tg and T(F½) are equal to or below the above-mentioned upper limit values and within the above-mentioned ranges, a problem that low temperature fixing ability of a resultant toner is impaired due to a high minimum fixing temperature of the toner can be effectively prevented. When Tg and T(F½) are equal to or above the lower limits and within the above-mentioned ranges, a problem that high-temperature and high-humidity resistant storage stability and hot offset resistance of the toner are deteriorated can be effectively prevented.

(Measurements of Tg and T(F½))

Tg is measured as follows. A sample is weighed by from 0.01 g through 0.02 g in an aluminium pan. By means of a differential scanning calorimeter (DSC210, available from Seiko Instruments Inc.), the sample is heated to 200 degrees Celsius, then is cooled from 200 degrees Celsius to 0 degrees Celsius at a cooling speed of 10 degrees Celsius/min, and then heated at a heating speed of 10 degrees Celsius/min. A temperature of a cross point between an extended line of a base line equal to or lower than the maximum endothermic peak temperature and a tangent line exhibiting the maximum inclination from a rising part of a peak to an apex of the peak is determined as Tg.

A flow tester (CFT-500D, available from Shimadzu Corporation) is used for a measurement of T(F½). A load of 1.96 MPa is applied to 1 g of a sample by a plunger with heating the sample at a heating speed of 6 degrees Celsius/min. The sample is then pushed out from a nozzle having a diameter of 1 mm and a length of 1 mm. The dropped amount of the plunger of the flow tester relative to the temperature is plotted. A temperature at which a half of the sample is flown out is determined as T(F½).

<<Molecular Weight of Toner>>

The toner of the present disclosure preferably has a weight average molecular weight (Mw) of from 6,000 through 12,000 and more preferably from 7,000 through 10,000. When the weight average molecular weight is 6,000 or greater, the following problems can be effectively prevented. The problem is that a glass transition temperature of the toner becomes low and storage stability of the toner becomes poor, and therefore particles of the toner are aggregated in a storage environment. Moreover, the problem is that viscoelasticity of the toner becomes too low at a high temperature and hot offset resistance of the toner is impaired. When the weight average molecular weight is 12,000 or less, the following problem can be effectively prevented. The problem is that the viscoelasticity of the toner becomes too high to impair spreadability and therefore low temperature fixing ability and glossiness of the toner are impaired. The weight average molecular weight of the toner of the present disclosure can be determined by measuring a molecular weight distribution of a THF-soluble component by means of a gel permeation chromatography (GPC) measuring device GPC-150C (available from WATERS).

The measurement is performed according to the following method using columns (KF801 to 807, available from Shodex). The columns are stabilized in a heat chamber of 40 degrees Celsius. As a solvent, THF is streamed into the columns at 40 degrees Celsius at a flow rate of 1 mL/min. After sufficiently dissolving 0.05 g of a sample in 5 g of THF, the resultant solution is filtered through a filter for a pretreatment (for example, a chromatodisk having a pore diameter of 0.45 micrometers (available from KURABO INDUSTRIES LTD.) to ultimately prepare a THF sample solution of the resin that has a sample concentration of from 0.05 percent by mass through 0.6 percent by mass. The prepared THF sample solution (from 50 microliters through 200 microliters) is injected for measurement.

As for a weight average molecular weight Mw and a number average molecular weight Mn of the THF-soluble component of the sample, a molecular weight distribution of the sample can be calculated from the correlation between the logarithmic values of the number of counts of the calibration curve that is prepared from monodisperse polystyrene standard samples.

As standard polystyrene samples for preparing a calibration curve, for example, polystyrene samples having molecular weights of $6\times10^2$, $2.1\times10^2$, $4\times10^2$, $1.75\times10^4$, $5.1\times10^4$, $1.1\times10^5$, $3.9\times10^5$, $8.6\times10^5$, $2\times10^6$, and $4.48\times10^6$ available from Pressure Chemical Co. or TOSOH CORPORATION can be used. It is appropriate that at least about 10 standard polystyrene samples are used. Moreover, a refractive index (RI) detector is used as a detector.

<Analysis of Each Ingredient of Toner>

<<Analysis of Fluorescent Colorant through Component Analysis by GC-MS>>

The confirmation of the presence of the fluorescent colorant in the toner and quantitative analysis of the fluorescent colorant in the toner can be performed in the following manner by the following devices under the following conditions.

(Treatment of Sample) To about 1 mg of a sample, about 1 microliter of a methylating agent (a 20 percent tetramethylammonium hydroxide methanol solution: TMAH) is dripped. The resultant is used as a sample.

(Measurement) Pyrolysis-gas chromatography mass spectrometer (Py-GCMS) Analysis device: QP2010, available from Shimadzu Corporation Heating furnace: Py2020D, available from Frontier Laboratories Ltd. Heating temperature: 320 degrees Celsius Column: Ultra ALLOY-5L=30 m, I.D=0.25 mm, Film=0.25 micrometers Column temperature: 50 degrees Celsius (maintained for 1 minute), heating (10 degrees Celsius/min) to 340 degrees Celsius (maintained for 7 minutes) Split ratio: 1:100 Column flow rate: 1.0 mL/min Ionization method: EI method (70 eV) Measuring mode: scan mode Search data: NIST 20 MASS SPECTRAL LIB.

<<Analysis of Fluorescent Colorant through Component Analysis by NMR>>

The confirmation of the presence of the fluorescent colorant in the toner and quantitative analysis of the fluorescent colorant in the toner can be performed in the following manner by the following devices under the following conditions.

(Preparation of Sample)

(1) Sample for $^1$H-NMR

A sample (from about 40 mg through about 50 mg) is dissolved in about 0.7 mL (d=1.48) of $CDCl_3$ including TMS. The resultant is used as a sample.

(2) Sample for $^{13}$C-NMR

A sample (from about 250 mg through about 260 mg) is dissolved in about 0.7 mL (d=1.48) of $CDCl_3$ including TMS. The resultant is used as a sample.

(Analysis Device and Measuring Conditions)

ECX-500 NMR device, available from JEOL Ltd.

(1) Measuring nucleus=$^1$H (500 MHz), measuring pulse file=single pulse. ex2 (1H), 45 degrees pulse Integration: 16 times, relaxation delay: 5 seconds, data point: 32 K, observation width: 15 ppm (2) Measuring nucleus=$^{13}$C (125 MHz), measuring pulse file=single pulse dec. ex2(1H), 30 degrees pulse Integration: 1,000 times (1,039 times, only RNC-501), relaxation delay: 2 seconds, data point: 32K, offset: 100 ppm, observation width: 250 ppm <Release Agent>

The release agent is not particularly limited and may be appropriately selected depending on the intended purpose. The release agent may be used alone or in combination.

In the case where an image is formed by overlapping images, such as forming an image on top of a toner layer, it is desired for the toner layer (fluorescent toner layer) present at the outermost surface to have particularly high hot offset resistance. When the release agent is included in the toner, release properties against a fixing member can be enhanced.

As the release agent for use, used can be aliphatic hydrocarbons (e.g., liquid paraffin, microcrystalline wax, natural paraffin, synthetic paraffin, polyolefin wax, partial oxides thereof, fluorides thereof, and chlorides thereof), animal oils (e.g., beef tallow and fish oil), vegetable oils (e.g., coconut oil, soybean oil, rapeseed oil, rice bran wax, and carnauba wax), higher aliphatic alcohol or higher fatty acid (e.g., montan wax), fatty acid amide, fatty acid bisamide, metal soap (e.g., zinc stearate, calcium stearate, magnesium stearate, aluminium stearate, zinc oleate, zinc palmitate, magnesium palmitate, zinc myristate, zinc laurate, and zinc behenate), fatty acid esters, polyvinylidene fluoride, etc. However, the release agent is not limited to the above-listed examples.

<Inorganic Particles for Internal Addition>

The binder resin of the toner of the present disclosure is plasticized to reduce a glass transition temperature of the toner when the fluorescent colorant and the binder resin are compatible with each other. As a result, the toner deforms at a temperature near a glass transition temperature of the toner and blocking may be caused.

As a more preferable embodiment of the present disclosure, therefore, the toner includes inorganic particles for internal addition. The inorganic particles are added inside the toner and dispersed in the binder resin. As a result, deformation of the toner can be prevented because strength of the toner is improved by the filler. Therefore, use of the inorganic particles for internal addition can more strongly assure high-temperature and high-humidity resistant storage stability of a resultant toner.

In the present disclosure, the inorganic particles for internal addition are provided for formation of toner base particles, together with other toner raw materials, such as a binder resin. Since the inorganic particles for internal addition are dispersed inside each toner base particle, the inorganic particles for internal addition can be clearly distinguished from inorganic particles for external addition (external additives) which are externally added to toner base particles after formation of the toner base particles. Examples of the inorganic particles for internal addition include silica, alumina, titanium oxide, barium titanate, magnesium titanate, calcium titanate, strontium titanate, zinc oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide, and, silicon nitride. Among the above-listed examples, silica, alumina, and titanium oxide are preferable.

As inorganic particles, moreover, inorganic particles subjected to a surface treatment with a hydrophobizing agent may be used. Examples of the hydrophobizing agent include a silane coupling agent, a sililation agent, a silane coupling agent having a fluoroalkyl group, an organic titanate-based coupling agent, and an aluminium-based coupling agent. Moreover, use of silicone oil as a hydrophobizing agent can also give a sufficient effect.

An average primary particle diameter of the inorganic particles is preferably from 5 nm through 500 nm and more preferably from 5 nm through 200 nm. When the average primary particle diameter is 5 nm or greater, the following problem can be effectively prevented. The problem is that the inorganic particles are not homogeneously dispersed in a toner because aggregations of the inorganic particles occur. When the average primary particle diameter is 500 nm or less, an improvement in high-temperature and high-humidity resistant storage stability owing to a filler effect can be expected. The average particle diameter can be directly measured from a photograph obtained by a transmission electron microscope. It is preferable that at least 100 particles or more be observed and an average value of major axes of the observed particles be used as the average particle diameter.

As an amount of the inorganic particles for internal addition in the toner of the present disclosure, an amount of the inorganic particles for internal addition is preferably from 0.1 parts by mass through 3.0 parts by mass and more preferably from 0.5 parts by mass through 3.0 parts by mass when a total amount of the binder resin and the release agent in the toner is 100 parts by mass (which can be read as the binder resin in the toner being 100 parts by mass in the case where the toner does not include the release agent).

<Other Ingredients>

The toner of the present disclosure may include other ingredients, such as a charge controlling agent, and inorganic particles for external addition (external additives).

<<Charge Controlling Agent>>

The toner can include a charge controlling agent.

Examples of the charge controlling agent include: nigrosine and modified products thereof with fatty acid metal salts; onium salts (e.g. phosphonium salts) and lake pigments thereof; triphenylmethane dyes and lake pigments thereof; metal salts of higher fatty acids; diorgano tin oxide, such as dibutyl tin oxide, dioctyl tin oxide, and dicyclohexyl tin oxide; diorgano tin borate, such as dibutyl tin borate, dioctyl tin borate, and dicyclohexyl tin borate; organic metal complexes; chelate compounds; monoazo metal complexes; acetyl acetone metal complexes; aromatic hydroxy-carboxylic acids; aromatic dicarboxylic acid-based metal complexes; and quaternary ammonium salts. Other examples include: aromatic hydroxycarboxylic acid, aromatic mono- or polycarboxylic acid, metal salts thereof, anhydrides thereof, esters thereof, and phenol derivatives (e.g., bisphenol) thereof.

The above-listed charge controlling agents may be used alone or in combination. When the charge controlling agent is internally added to the toner, the charge controlling agent is preferably added to the binder resin in an amount of from 0.1 parts by mass through 10 parts by mass. Moreover, there is also a case where a toner may be colored by the charge controlling agent. As the charge controlling agent, therefore, a material that is as transparent as possible is selected for use in the toner except a black toner.

<<Inorganic Particles for External Addition>>

As inorganic particles for external addition (external additives) for use in the present disclosure, inorganic particles identical to the inorganic particles for internal addition can be used.

<Production Method of Toner>

A production method of the toner can be appropriately selected from production methods known in the art, as long as the above-described specifications defined in the present disclosure can be satisfied. Examples of the production method of the toner of the present disclosure include a knead and pulverization method, and a so-called chemical method where toner particles are formed in an aqueous medium.

In order to produce the toner of the present disclosure, for example, a binder resin, a colorant, optionally a release agent, inorganic particles for internal addition, and moreover a charge controlling agent as required are combined, and the resultant mixture is sufficiently mixed by a mixer, such as Henschel Mixer and Super Mixer. Subsequently, the mixture is melt-kneaded by means of a hot melt kneader, such as heat rolls, a kneader, and an extruder, to thereby sufficiently mix the materials. Thereafter, the melt-kneaded product is cooled and solidified. Then, pulverization and classification are performed to thereby obtain a toner. As the pulverization method, a jet mill method, an interparticle collision method, a mechanical pulverization method, etc. can be used. The jet mill method is a method where a toner is included in a high-speed air flow, the toner is crushed into an impact board, and the toner is pulverized using the energy of the impact. The interparticle collision method is a method where toner particles are crushed into one another in an air flow. The mechanical pulverization method is a method where a toner is supplied into a narrow gap with a rotor rotating at high speed to pulverize the toner.

Moreover, the toner of the present disclosure can be produced by a dissolution suspension method where an oil phase, in which toner materials are dissolved or dispersed in an organic solvent phase, is dispersed in an aqueous medium phase, a reaction of the resin is performed followed by removal of the solvent, and filtration, washing, and drying are performed to produce base particles of a toner.

(Developer)

A developer of the present disclosure includes at least the toner. The developer may be a one-component developer or a two-component developer.

A preferable embodiment is that the toner of the present disclosure is mixed with a carrier to prepare a two-component developer and the two-component developer is used for an electrophotographic image forming method of a two-component developing system.

In the case where a two-component developing system is used, as magnetic particles for use in a magnetic carrier, spinel ferrite (e.g., magnetite and gamma ferric oxide), spinel ferrite including one or two or more metals other than iron (e.g., Mn, Ni, Zn, Mg, and Cu), magnetoplumbite ferrite (e.g., barium ferrite), or particles of iron or an alloy having an oxide layer at a surface of each particle can be used.

Shapes of the particles may be granular shapes, spherical shapes, or needle shapes. Particularly in the case where high magnetization is desired, ferromagnetic particles, such as iron, can be preferably used. In view of chemical stability, moreover, spinel ferrite including magnetite or gamma ferric oxide, or magnetoplumbite ferrite including barium ferrite is preferably used.

Specifically, preferable examples of the magnetic particles include: MFL-35S and MFL-35HS (available from Powdertech Co., Ltd.); and DFC-400M, DFC-410M, and SM-350NV (available from DOWA IP CREATION CO., LTD.).

A resin carrier having desired magnetization can be used by selecting a type and amount of ferromagnetic particles. As the magnetic properties of the carrier, the strength of the magnetization at 1,000 oersted is preferably from 30 emu/g through 150 emu/g. The resin carrier can be produced by spraying a melt-kneaded product including magnetic particles and an insulating binder resin by means of a spray dryer, or allowing a monomer or prepolymer to react in an aqueous medium in the presence of magnetic particles and curing to obtain a condensation binder in which the magnetic particles are dispersed.

Charging properties of the magnetic carrier can be controlling by adhering positively or negatively charged particles or conductive particles on surface of the magnetic carrier or coating the surface of the magnetic carrier with a resin.

As the surface coating material (resin), a silicone resin, an acrylic resin, an epoxy resin, a fluorine-based resin, etc. are used. Moreover, coating can be performed with the coating material including positively or negatively charged particles or conductive particles. The coating material is preferably a silicone resin or an acrylic resin. In the present disclosure, a mass ratio of the carrier in the developer stored in the developing device is preferably 85 percent by mass or greater but less than 98 percent by mass. When the mass ratio is 85 percent by mass or greater, formation of defective images caused by toner scattering from a developing device can be prevented. When the mass ratio of the carrier in the developer is less than 98 percent by mass, a notable increase in a charging amount of the toner for electrophotographic developing and insufficient supply amount of the toner for electrophotographic developing can be suppressed, and therefore a decrease in image density and formation of defective images can be effectively prevented.

(Toner Stored Unit)

A toner stored unit of the present disclosure is a unit that has a function of storing a toner and stores the toner. Examples of embodiments of the toner stored unit include a toner stored container, a developing device, and a process cartridge.

The toner stored container is a container in which a toner is stored.

The developing device is a device including a unit configured to store a toner and develop.

The process cartridge is a process cartridge which includes at least an electrostatic latent image bearer (also referred to as an image bearer) and a developing unit that are integrated, stores a toner, and is detachably mounted in an image forming apparatus. The process cartridge may further include at least one selected from a charging unit, an exposing unit, and a cleaning unit.

Formation of an image utilizing characteristics of the toner that can reproduce fluorescent pink having high fluorescence which cannot be reproduced with process colors known in the art can be performed by performing image formation using an image forming apparatus in which the toner stored unit of the present disclosure is mounted.

(Image forming Apparatus and Image forming Method)

An image forming apparatus of the present disclosure includes at least an electrostatic latent image bearer, an electrostatic latent image forming unit, and a developing unit. The image forming apparatus may further include other units according to the necessity.

An image forming method associated with the present disclosure includes at least an electrostatic latent image forming step and a developing step. The image forming method may further include other steps according to the necessity.

The image forming method is preferably performed by the image forming apparatus. The electrostatic latent image forming step is preferably performed by electrostatic latent image forming unit. The developing step is preferably performed by the developing unit. The above-mentioned other steps are preferably performed by the above-mentioned other units.

The image forming apparatus of the present disclosure more preferably includes an electrostatic latent image bearer, an electrostatic latent image forming unit configured to form an electrostatic latent image on the electrostatic latent image bearer, a developing unit including a toner and configured to develop the electrostatic latent image formed on the electrostatic latent image bearer with the toner to form a toner image, a transferring unit configured to transfer the toner image formed on the electrostatic latent image bearer to a surface of a recording medium, and a fixing unit configured to fix the toner image transferred to the surface of the recording medium.

Moreover, the image forming method of the present disclosure more preferably includes an electrostatic latent image forming step, a developing step, a transferring step, and a fixing step. The electrostatic latent image forming step includes forming an electrostatic latent image on an electrostatic latent image bearer. The developing step includes developing the electrostatic latent image formed on the electrostatic latent image bearer with a toner to form a toner image. The transferring step includes transferring the toner image formed on the electrostatic latent image bearer to a surface of a recording medium. The fixing step include fixing the toner image transferred to the surface of the recording medium.

In the developing unit and the developing step, the toner is used. Preferably, the toner image may be formed by using a developer including the toner and optionally further including other ingredients, such as a carrier.

The image forming apparatus of the present disclosure preferably includes the developing units that are a combination of a plurality of colors of toners. As one of a plurality of colors of the toners, the fluorescent pink toner of the present disclosure is used. As other toners, appropriate colors of toners are selected according to the intended purpose.

For example, a preferable embodiment is that the number of the developing units be 5, and the color toners for use be a combination of a black toner, a cyan toner, a magenta toner, a yellow toner, and the fluorescent pink toner of the present disclosure.

Examples of other color toners used in combination with the fluorescent pink toner of the present disclosure include toners including non-fluorescent colorants listed below.

Examples of the color toners include process color toners of black, cyan, magenta, and yellow, and specific color toners, such as a white toner, a green toner, a blue toner, and a metallic toner.

Colorants used in the above-listed toners are not particularly limited and colorants typically used can be appropriately selected and used.

As a black toner, a black toner whose hue and brightness are adjusted by carbon black alone or mixing carbon black as main component with copper phthalocyanine is preferable.

As a cyan toner, a cyan toner, in which Pigment Blue 15:3 that is copper phthalocyanine alone is included or aluminium phthalocyanine is mixed with the colorant, is preferable.

As a magenta toner, Pigment Red 53:1, Pigment Red 81, Pigment Red 122, or Pigment Red 269 is used alone or as a mixture.

As a yellow toner, Pigment Yellow 74, Pigment Yellow 155, Pigment Yellow 180, or Pigment Yellow 185 is used alone or as a mixture. Pigment Yellow 185 alone or a mixture of Pigment Yellow 185 and Pigment Yellow 74 is preferably used in view of saturation and storage stability.

As a white toner, titanium dioxide surface treated with silicon, zirconia, aluminium, or polyol can be used.

As a green toner, Pigment Green 7 etc. can be used, but safety needs to be considered for use.

Examples of a blue toner include Pigment Blue 15:1 and Pigment Violet 23.

A schematic view of the image forming apparatus according to the present embodiment is illustrated in FIG. 1. In FIG. 1, a developing unit of a fluorescent pink toner is emitted, but the developing unit of the fluorescent pink toner is similarly arranged with other developing units of yellow, cyan, magenta, and black toners (see FIG. 3). The image forming apparatus of FIG. 1 is a so-called tandem image forming apparatus, in which 5 image forming units 20Y, C, M, K, and A of yellow, cyan, magenta, black, and fluorescent pink are disposed in parallel, toner images of yellow (Y), cyan (C), magenta (M), black (K), and fluorescent pink (A) formed by the toner image forming units are superimposed to form a full-color image. Note that, an alignment of the toner image forming units of the above-mentioned colors is not particularly limited.

Each toner image forming unit 20Y, C, M, K, or A includes, as an image bearer, a photoconductor drum 4Y, C, M, K, or A that is rotatably driven. Moreover, disposed is an exposure device 45 that is configured to apply laser light or LED light to each photoconductor drum 4Y, C, M, K, or A based on image information of each color to form a latent image.

As an intermediate transfer member, moreover, an intermediate transfer belt 60 is arranged to face the toner image forming units 20Y, C, M, K, and A in a manner that a surface of the intermediate transfer belt 60 is movable. Primary transfer rollers 61Y, C, M, K, and A each configured to transfer a toner image of the corresponding color formed on the photoconductor drum 4Y, C, M, K, or A of the corresponding color to the intermediate transfer belt 60 are disposed at the position facing to the photoconductor drums 4Y, C, M, K, and A via the intermediate transfer belt 60.

The primary transfer rollers 61 Y, C, M, K, and A are configured to sequentially transfer and superimpose toner images formed by the below-mentioned toner image forming units 20Y, C, M, K, and A to the intermediate transfer belt 60 to thereby form a full-color image.

Moreover, a secondary transfer device 65, which is configured to transfer the toner images on the intermediate transfer belt 60 to transfer paper at once, is disposed in the downstream position from the primary transfer rollers 61Y, C, M, K, and A relative to the surface traveling direction of the intermediate transfer belt 60. Furthermore, a belt cleaning device 66 configured to remove the toner remained on the surface of the intermediate transfer belt 60 is disposed in the downstream position from the secondary transfer device 65.

In the bottom part of the image forming apparatus, a paper feeding unit 70 including a paper feeding cassette 71, a paper feeding roller 72, etc. is disposed and the paper feeding unit 70 feeds transfer paper towards registration rollers 73. The registration rollers 73 are configured to send the transfer paper to the counter area between the intermediate transfer belt 60 and the secondary transfer device 65 by synchronizing the timing with formation of the toner images. The full-color image on the intermediate transfer belt 60 is transferred onto transfer paper by the secondary transfer device 65, and the full-color image is fixed by a fixing device 90, followed by discharging a resultant print to the outside from the image forming apparatus.

Next, each of the toner image forming unit 20Y, C, M, K, and A will be described. The structures and operations of the toner image forming units 20Y, C, M, K, and A are almost the same except that the color of the toner stored inside is different. Therefore, the structure and operation of the toner image forming unit 20 will be described with omitting the letters Y, C, M, K, and A given for classification of the colors in the descriptions below. FIG. 2 is a schematic view for describing a structure of a main part in one embodiment of the image forming apparatus.

In the surrounding area of the photoconductor drum 4 of the toner image forming unit 20, units for performing an electrophotographic process, such as a charging device 40, a developing device 50, and a cleaning device 30, are disposed. A toner image of each color is formed on the photoconductor drum 4 by the operation known in the art. The toner image forming unit 20 may be a process cartridge having an integrated structure including the toner image forming unit and detachably mounted in a main body of an image forming apparatus.

FIG. 3 is a schematic view of a structure of a main part in one example of an image forming apparatus including 5 developing units. Note that, descriptions of parts or matter identical to the image forming apparatus above are omitted.

The image forming apparatus of the present embodiments includes photoconductors 5, 11, 17, 23, and 29. In the surrounding area of each of the photoconductors, a charging unit 6, 12, 18, 24, or 30, a developing unit 8, 14, 20, 26, or 32, a transferring unit 10, 16, 22, 28, or 34, and a cleaning device 9, 15, 21, 27, or 33 are disposed. The photoconductor is irradiated with exposure light 7, 13, 19, 25, or 31.

The developing unit of each color includes the photoconductor, the charging unit, the developing unit, the cleaning device, etc. Image formation is performed with a fluorescent pink toner in the developing unit 35, with a black toner in the developing unit 36, with a cyan toner in the developing unit 37, with a magenta toner in the developing unit 38, and with a yellow toner in the developing unit 39. The formed images are transferred to an intermediate transfer belt 40. The images formed on the intermediate transfer belt 40 are transferred to a recording medium by a transferring device 41 and fixed by a fixing device 43.

Note that, in the present disclosure, the transfer material is also referred to as a recording medium, a recording material, transfer paper, a recording sheet, etc., but the transfer material is not particularly limited. Any of transfer materials known in the art can be used as the transfer material.

EXAMPLES

The present disclosure will be described more detail by way of Examples. However, the present disclosure should not be construed as being limited to these Examples. Note that, "part(s)" denotes "part(s) by mass" unless otherwise stated, and "percent" denotes "percent by mass" unless otherwise stated.

(Production Example of Toner 1)

Polyester resin RN-290 (acid value: 28 mgKOH/g, available from Kao Corporation): 15.8 parts by mass Polyester resin RN-306 (acid value: 2 mgKOH/g, available from Kao Corporation): 78.9 parts by mass Carnauba wax WA-05 (available from CERARICA NODA Co., Ltd.): 5.3 parts by mass Solvent Red 49 (ROB-B, available from ORIENT CHEMICAL INDUSTRIES CO., LTD.): 1.0 part by mass C.I. Pigment Yellow 101 (Lumogen Yellow S0795, available from BASF Japan Ltd.): 0.5 parts by mass Silica for internal addition (HDK-2000, available from Clariant): 3.0 parts by mass The toner raw materials above were pre-mixed by means of Henschel Mixer (FM20B, available from NIPPON COKE & ENGINEERING CO., LTD.), followed by melting and kneading the resultant mixture by means of a single-screw kneader (Kneader cokneader, available from Buss AG) at a temperature of from 100 degrees Celsius through 130 degrees Celsius. After cooling the obtained kneaded product to room temperature, the kneaded product was roughly pulverized by means of Rotoplex into the size of from 200 micrometers through 300 micrometers. Subsequently, the resultant was finely pulverized by means of a counter jet mill (100AFG, available from HOSOKAWA MICRON CORPORATION) with appropriately adjusting the pulverization air pressure in a manner that a weight average particle diameter of the resultant was to be 6.2±0.3 micrometers. Thereafter, the resultant particles were classified by means of an air classifier (EJ-LABO, available from MATSUBO Corporation) with adjusting an opening degree of a louver in a manner that a weight average particle diameter of the resultant was to be 7.0±0.2 micrometers and a ratio of the weight average particle diameter to a number average particle diameter was to be 1.20 or less, to thereby obtain toner base particles.

Subsequently, 1.0 part of additives (HDK-2000, available from Clamant) and 1.0 part of additives (H05TD, available from Clamant) were stirred into and mixed with 100 parts by mass of the toner base particles by means of Henschel Mixer to thereby produce Toner 1.

The toner particles (Toner 1) produced in the above-mentioned manner had an acid value of 6.1 mgKOH/g, Mw of 11,461, Tg of 56.9 degrees Celsius, and T(½) of 107.6 degrees Celsius.

(Production Example of Toner 2)

Polyester resin RN-290 (acid value: 28 mgKOH/g, available from Kao Corporation): 15.8 parts by mass Polyester resin RN-263 (acid value: 7 mgKOH/g, available from Kao Corporation): 78.9 parts by mass Carnauba wax WA-05 (available from CERARICA NODA Co., Ltd.): 5.3 parts by mass Solvent Red 49 (ROB-B, available from ORIENT CHEMICAL INDUSTRIES CO., LTD.): 1.0 part by mass C.I. Pigment Yellow 101 (Lumogen Yellow S0795, available from BASF Japan Ltd.): 0.5 parts by mass Silica for internal addition (HDK-2000, available from Clariant): 3.0 parts by mass Toner 2 was produced in the same manner as the production methods of Toner 1, except that the toner raw materials above were used.

The toner particles (Toner 2) produced in the manner above had an acid value of 9.5 mgKOH/g, Mw of 7,251, Tg of 51.75 degrees Celsius, and T(½) of 106.2 degrees Celsius.

(Production Example of Toner 3)

Polyester resin RN-290 (acid value: 28 mgKOH/g, available from Kao Corporation): 15.8 parts by mass Polyester resin RSE-825 (acid value: 9 mgKOH/g, available from Sanyo Chemical Industries, Ltd.): 78.9 parts by mass Carnauba wax WA-05 (available from CERARICA NODA Co., Ltd.): 5.3 parts by mass Solvent Red 49 (ROB-B, available from ORIENT CHEMICAL INDUSTRIES CO., LTD.): 1.0 part by mass C.I. Pigment Yellow 101 (Lumogen Yellow S0795, available from BASF Japan Ltd.): 0.5 parts by mass Silica for internal addition (HDK-2000, available from Clariant): 3.0 parts by mass Toner 3 was produced in the same manner as the production methods of Toner 1, except that the toner raw materials above were used.

The toner particles (Toner 3) produced in the manner above had an acid value of 11.0 mgKOH/g, Mw of 11,700, Tg of 53.05 degrees Celsius, and T(½) of 116.4 degrees Celsius.

(Production Example of Toner 4)

Polyester resin RN-290 (acid value: 28 mgKOH/g, available from Kao Corporation): 15.8 parts by mass Polyester resin EXL-101 (acid value: 12 mgKOH/g, available from Sanyo Chemical Industries, Ltd.): 78.9 parts by mass Carnauba wax WA-05 (available from CERARICA NODA Co., Ltd.): 5.3 parts by mass Solvent Red 49 (ROB-B, available from ORIENT CHEMICAL INDUSTRIES CO., LTD.): 1.0 part by mass C.I. Pigment Yellow 101 (Lumogen Yellow S0795, available from BASF Japan Ltd.): 0.5 parts by mass Silica for internal addition (HDK-2000, available from Clariant): 3.0 parts by mass Toner 4 was produced in the same manner as the production methods of Toner 1, except that the toner raw materials above were used.

The toner particles (Toner 4) produced in the manner above had an acid value of 13.2 mgKOH/g, Mw of 7,710, Tg of 54.16 degrees Celsius, and T(½) of 112.7 degrees Celsius.

(Production Example of Toner 5)

Polyester resin RN-290 (acid value: 28 mgKOH/g, available from Kao Corporation): 31.5 parts by mass Polyester resin EXL-101 (acid value: 12 mgKOH/g, available from Sanyo Chemical Industries, Ltd.): 63.2 parts by mass Carnauba wax WA-05 (available from CERARICA NODA Co., Ltd.): 5.3 parts by mass Solvent Red 49 (ROB-B, available from ORIENT CHEMICAL INDUSTRIES CO., LTD.): 1.5 parts by mass C.I. Pigment Yellow 101 (Lumogen Yellow S0795, available from BASF Japan Ltd.): 0.25 parts by mass Silica for internal addition (HDK-2000, available from Clamant): 3.0 parts by mass Toner 5 was produced in the same manner as the production methods of Toner 1, except that the toner raw materials above were used.

The toner particles (Toner 5) produced in the manner above had an acid value of 15.6 mgKOH/g, Mw of 9,920, Tg of 55.19 degrees Celsius, and T(½) of 113.9 degrees Celsius.

(Production Example of Toner 6)

Polyester resin RN-290 (acid value: 28 mgKOH/g, available from Kao Corporation): 15.8 parts by mass Polyester resin EXL-101 (acid value: 12 mgKOH/g, available from Sanyo Chemical Industries, Ltd.): 52.6 parts by mass Polyester resin RN-306 (acid value: 2 mgKOH/g, available from Kao Corporation): 26.3 parts by mass Carnauba wax WA-05 (available from CERARICA NODA Co., Ltd.): 5.3 parts by mass Solvent Red 49 (ROB-B, available from ORIENT CHEMICAL INDUSTRIES CO., LTD.): 2.0 part by mass C.I. Pigment Yellow 101 (Lumogen Yellow S0795, available from BASF Japan Ltd.): 0.25 parts by mass Silica for internal addition (HDK-2000, available from Clariant): 3.0 parts by mass Toner 6 was produced in the same manner as the production methods of Toner 1, except that the toner raw materials above were used.

The toner particles (Toner 6) produced in the manner above had an acid value of 10.2 mgKOH/g, Mw of 8,563, Tg of 58.44 degrees Celsius, and T(½) of 113.7 degrees Celsius.

(Production Example of Toner 7)

Polyester resin RN-290 (acid value: 28 mgKOH/g, available from Kao Corporation): 52.6 parts by mass Polyester resin EXL-101 (acid value: 12 mgKOH/g, available from Sanyo Chemical Industries, Ltd.): 42.1 parts by mass Carnauba wax WA-05 (available from CERARICA NODA Co., Ltd.): 5.3 parts by mass Solvent Red 49 (ROB-B, available from ORIENT CHEMICAL INDUSTRIES CO., LTD.): 1.5 parts by mass C.I. Pigment Yellow 101 (Lumogen Yellow S0795, available from BASF Japan Ltd.): 0.25 parts by mass Silica for internal addition (HDK-2000, available from Clariant): 3.0 parts by mass Toner 7 was produced in the same manner as the production methods of Toner 1, except that the toner raw materials above were used.

The toner particles (Toner 7) produced in the manner above had an acid value of 18.8 mgKOH/g, Mw of 11,940, Tg of 52.69 degrees Celsius, and T(½) of 113.6 degrees Celsius.

(Production Example of Toner 8)

Polyester resin RN-290 (acid value: 28 mgKOH/g, available from Kao Corporation): 15.8 parts by mass Polyester resin EXL-101 (acid value: 12 mgKOH/g, available from Sanyo Chemical Industries, Ltd.): 78.9 parts by mass Carnauba wax WA-05 (available from CERARICA NODA Co., Ltd.): 5.3 parts by mass Solvent Red 49 (ROB-B, available from ORIENT CHEMICAL INDUSTRIES CO., LTD.): 1.0 part by mass C.I. Pigment Yellow 101 (Lumogen Yellow S0795, available from BASF Japan Ltd.): 0.5 parts by mass Toner 8 was produced in the same manner as the production methods of Toner 1, except that the toner raw materials above were used. The toner particles (Toner 8) produced in the manner above had an acid value of 13.2 mgKOH/g, Mw of 7,300, Tg of 54.02 degrees Celsius, and T(½) of 112.3 degrees Celsius.

(Production Example of Toner 9)

Polyester resin RN-290 (acid value: 28 mgKOH/g, available from Kao Corporation): 94.7 parts by mass Carnauba wax WA-05 (available from CERARICA NODA Co., Ltd.): 5.3 parts by mass Solvent Red 49 (ROB-B, available from ORIENT CHEMICAL INDUSTRIES CO., LTD.): 1.5 parts by mass C.I. Pigment Yellow 101 (Lumogen Yellow S0795, available from BASF Japan Ltd.): 0.25 parts by mass Silica for internal addition (HDK-2000, available from Clariant): 3.0 parts by mass Toner 9 was produced in the same manner as the production methods of Toner 1, except that the toner raw materials above were used.

The toner particles (Toner 9) produced in the manner above had an acid value of 25.2 mgKOH/g, Mw of 48,606, Tg of 52.16 degrees Celsius, and T(½) of 128.6 degrees Celsius.

(Production Example of Toner 10)

Polyester resin RN-289 (acid value: 38 mgKOH/g, available from Kao Corporation): 84.2 parts by mass Polyester resin RN-306 (acid value: 2 mgKOH/g, available from Kao Corporation): 10.5 parts by mass Carnauba wax WA-05 (available from CERARICA NODA Co., Ltd.): 5.3 parts by mass Solvent Red 49 (ROB-B, available from ORIENT CHEMICAL INDUSTRIES CO., LTD.): 1.5 parts by mass C.I. Pigment Yellow 101 (Lumogen Yellow S0795, available from BASF Japan Ltd.): 0.25 parts by mass Silica for internal addition (HDK-2000, available from Clariant): 3.0 parts by mass Toner 10 was produced in the same manner as the production methods of Toner 1, except that the toner raw materials above were used.

The toner particles (Toner 10) produced in the manner above had an acid value of 30.7 mgKOH/g, Mw of 9,262, Tg of 49.21 degrees Celsius, and T(½) of 100.1 degrees Celsius.

(Production Example of Toner 11)

Polyester resin RN-290 (acid value: 28 mgKOH/g, available from Kao Corporation): 15.8 parts by mass Polyester resin RN-263 (acid value: 7 mgKOH/g, available from Kao Corporation): 78.9 parts by mass Carnauba wax WA-05 (available from CERARICA NODA Co., Ltd.): 5.3 parts by mass OIL PINK 312 (available from ORIENT CHEMICAL INDUSTRIES CO., LTD.): 1.0 part by mass C.I. Pigment Yellow 101 (Lumogen Yellow S0795, available from BASF Japan Ltd.): 0.5 parts by mass Silica for internal addition (HDK-2000, available from Clariant): 3.0 parts by mass Toner 11 was produced in the same manner as the production methods of Toner 1, except that the toner raw materials above were used.

The toner particles (Toner 11) produced in the manner above had an acid value of 9.5 mgKOH/g, Mw of 7,251, Tg of 56.75 degrees Celsius, and T(½) of 106.2 degrees Celsius.

(Production Example of Toner 12)

Polyester resin RN-290 (acid value: 28 mgKOH/g, available from Kao Corporation): 15.8 parts by mass Polyester resin RN-263 (acid value: 7 mgKOH/g, available from Kao Corporation): 78.9 parts by mass Carnauba wax WA-05 (available from CERARICA NODA Co., Ltd.): 5.3 parts by mass Seika Light Rose R40 (available from Dainichiseika Color & Chemicals Mfg. Co. Ltd.): 1.0 part by mass C.I. Pigment Yellow 101 (Lumogen Yellow S0795, available from BASF Japan Ltd.): 0.5 parts by mass Silica for internal addition (HDK-2000, available from Clariant): 3.0 parts by mass Toner 12 was produced in the same manner as the production methods of Toner 1, except that the toner raw materials above were used.

The toner particles (Toner 12) produced in the manner above had an acid value of 9.5 mgKOH/g, Mw of 7,251, Tg of 57.7 degrees Celsius, and T(½) of 106.2 degrees Celsius.

(Production Example of Toner 13)

Polyester resin RN-290 (acid value: 28 mgKOH/g, available from Kao Corporation): 15.8 parts by mass Polyester resin RN-263 (acid value: 7 mgKOH/g, available from Kao Corporation): 78.9 parts by mass Carnauba wax WA-05 (available from CERARICA NODA Co., Ltd.): 5.3 parts by mass Solvent Red 49 (ROB-B, available from ORIENT CHEMICAL INDUSTRIES CO., LTD.): 1.5 parts by mass Silica for internal addition (HDK-2000, available from Clariant): 3.0 parts by mass Toner 13 was produced in the same manner as the production methods of Toner 1, except that the toner raw materials above were used.

The toner particles (Toner 13) produced in the manner above had an acid value of 9.5 mgKOH/g, Mw of 7,251, Tg of 50.95 degrees Celsius, and T(½) of 106.2 degrees Celsius.

(Production Example of Toner 14)

Polyester resin RN-290 (acid value: 28 mgKOH/g, available from Kao Corporation): 73.7 parts by mass Polyester resin RN-263 (acid value: 7 mgKOH/g, available from Kao Corporation): 21.0 parts by mass Carnauba wax WA-05 (available from CERARICA NODA Co., Ltd.): 5.3 parts by mass Solvent Red 49 (ROB-B, available from ORIENT CHEMICAL INDUSTRIES CO., LTD.): 1.5 parts by mass C.I. Pigment Yellow 101 (Lumogen Yellow S0795, available from BASF Japan Ltd.): 0.25 parts by mass Silica for internal addition (HDK-2000, available from Clariant): 3.0 parts by mass Toner 14 was produced in the same manner as the production methods of Toner 1, except that the toner raw materials above were used.

The toner particles (Toner 14) produced in the manner above had an acid value of 27.2 mgKOH/g, Mw of 35,800, Tg of 51.95 degrees Celsius, and T(½) of 123.2 degrees Celsius.

(Production Example of Toner 15)

Polyester resin RN-290 (acid value: 28 mgKOH/g, available from Kao Corporation): 15.8 parts by mass Polyester resin RN-263 (acid value: 7 mgKOH/g, available from Kao Corporation): 78.9 parts by mass Carnauba wax WA-05 (available from CERARICA NODA Co., Ltd.): 5.3 parts by mass Solvent Red 49 (ROB-B, available from ORIENT CHEMICAL INDUSTRIES CO., LTD.): 1.5 parts by mass OIL Yellow 106 (available from ORIENT CHEMICAL INDUSTRIES CO., LTD.): 0.5 parts by mass Silica for internal addition (HDK-2000, available from Clariant): 3.0 parts by mass Toner 15 was produced in the same manner as the production methods of Toner 1, except that the toner raw materials above were used.

The toner particles (Toner 15) produced in the manner above had an acid value of 9.5 mgKOH/g, Mw of 7,251, Tg of 50.05 degrees Celsius, and T(½) of 106.2 degrees Celsius.

Note that, the polyester resin RN-290 used for the production of the toner, such as Toner 1 above, was confirmed to be a resin having a chloroform-insoluble component.

(Production of Two-Component Developer)

<Production of Carrier>

Silicone resin (organo straight silicone): 100 parts

Toluene: 100 parts

Gamma-(2-aminoethyl)aminopropyltrimethoxysilane: 5 parts

Carbon black: 10 parts

The mixture above was dispersed for 20 minutes by a homomixer to prepare a coating layer-forming liquid. Mn ferrite particles having a weight average particle diameter of 35 micrometers were used as a core material. The prepared coating layer-forming liquid was applied to a surface of the core material and dried by means of a fluidized bed coating device in a manner that an average film thickness on the surface of the core material was to be 0.20 micrometers with controlling an internal temperature of each flow tank to 70 degrees Celsius. The obtained carrier was fired for 2 hours at 180 degrees Celsius in an electric furnace to thereby obtain Carrier A.

<Production of Two-Component Developer>

The produced toner and Carrier A were homogeneously mixed to charge by means of TURBULA mixer (available from Willy A. Bachofen (WAB) AG Maschinenfabrik) for 5 minutes at 48 rpm to thereby produce a two-component developer. Note that, a mixing ratio between the toner and the carrier was adjusted to a toner density (4 percent by mass) of an initial developer of an evaluation device.

(Evaluations)

Two-component developers produced using Toners 1 to 15 above were evaluated according to the following evaluation methods. The results are presented in Tables 1-1, 1-2, and 1-3.

<Fluorescence>

A developing unit of Imagio Neo C350 (available from Ricoh Company Limited) was charged with each of two-component developers produced with Toners 1 to 15 and a solid image was output on POD gloss paper (available from Oji Paper Co., Ltd.) with adjusting in a manner that a deposition amount was to be 0.65 mg/cm$^3$ with which preferable coloring properties could be obtained. Note that, the deposition amount of an amount of the toner deposited on transfer paper.

A L* value of the obtained image measured by a m1 light source and a L* value of the obtained image measured by a m2 light source were obtained, and a value obtained by (L* value measured by m2 light source)−(L* value measured by m1 light source) was determined as an index value of fluorescence (delta L*). The larger delta L* is the higher fluorescence is. A result where the delta L* was less than 2.0 was regarded as unacceptable.

The measured value was obtained by measuring by means of a spectrophotometer X-Rite EXACT (available from X-Rite Inc.) under conditions of the measuring color status T.

<High-temperature and high-humidity resistant storage stability>

The toner was weighed by 0.5 g in a tube for a centrifuge. The toner was stored for 2 weeks under the conditions having a temperature of 40 degrees Celsius and relative humidity of 70 percent. Thereafter, the toner was sieved through a mesh having an opening size of 106 micrometers and an amount of loose aggregates remained on the mesh was measured.

The high-temperature and high-humidity resistant storage stability of the toner was evaluated based on the value of the amount of the loose aggregates according to the following criteria.

A result of D was regarded as unacceptable.

(Evaluation Criteria)

A: 150 mg/g or less

B: greater than 150 mg/g but 200 mg/g or less

B/C: greater than 200 mg/g but 230 mg/g or less

C: greater than 230 mg/g but 250 mg/g or less

D: greater than 250 mg/g

TABLE 1-1

| | | | Comp. Ex. 1 | Ex. 1 | Ex. 2 | Ex. 3 | Ex. 4 |
|---|---|---|---|---|---|---|---|
| Toner No. | | | 1 | 2 | 3 | 4 | 5 |
| Amount (parts by mass) | polyester resin | RN290 | 15.8 | 15.8 | 15.8 | 15.8 | 31.5 |
| | | RN263 | | 78.9 | | | |
| | | RN289 | | | | | |
| | | EXL-101 | | | | 78.9 | 63.2 |
| | | RN-306 | 78.9 | | | | |
| | | RSE-825 | | | 78.9 | | |
| | carnauba wax | WA-05 | 5.3 | 5.3 | 5.3 | 5.3 | 5.3 |
| | Solvent Red 49 | ROB-B | 1.0 | 1.0 | 1.0 | 1.0 | 1.5 |
| | another colorant | OP312 | | | | | |
| | another colorant | Seikalight Rose R40 | | | | | |
| | Pigment Yellow 101 | S0795 | 0.5 | 0.5 | 0.5 | 0.5 | 0.25 |
| | yellow colorant | OY106 | | | | | |
| | silica for internal addition | HDK2000 | 3.0 | 3.0 | 3.0 | 3.0 | 3.0 |
| Evaluation results | | acid value of toner (mgKOH/g) | 6.1 | 9.5 | 11.0 | 13.2 | 15.6 |
| | | fluorescence ΔL* | 1.9 | 2.4 | 3.5 | 4.3 | 4.7 |
| | | high -temperature high-humidity resistant storage stability | A | A | A | A | B |

TABLE 1-2

| | | | Ex. 5 | Ex. 6 | Ex. 7 | Ex. 8 | Comp. Ex. 2 |
|---|---|---|---|---|---|---|---|
| Toner No. | | | 6 | 7 | 8 | 9 | 10 |
| Amount (parts by mass) | polyester resin | RN290 | 15.8 | 52.6 | 15.8 | 94.7 | |
| | | RN263 | | | | | |
| | | RN289 | | | | | 84.2 |
| | | EXL-101 | 52.6 | 42.1 | 78.9 | | |
| | | RN-306 | 26.3 | | | | 10.5 |
| | | RSE-825 | | | | | |
| | carnauba wax | WA-05 | 5.3 | 5.3 | 5.3 | 5.3 | 5.3 |
| | Solvent Red 49 | ROB-B | 2.0 | 1.5 | 1.0 | 1.5 | 1.5 |
| | another colorant | OP312 | | | | | |
| | another colorant | Seikalight Rose R40 | | | | | |
| | Pigment Yellow 101 | S0795 | 0.25 | 0.25 | 0.5 | 0.25 | 0.25 |
| | yellow colorant | OY106 | | | | | |
| | silica for internal addition | HDK2000 | 3.0 | 3.0 | 0 | 3.0 | 3.0 |
| Evaluation results | | acid value of toner (mgKOH/g) | 10.2 | 18.8 | 13.2 | 25.2 | 30.7 |
| | | fluorescence ΔL* | 2.8 | 4.8 | 4.3 | 4.9 | 4.9 |
| | | high -temperature high-humidity resistant storage | B | B | B/C | B | D |

TABLE 1-3

| | | | Comp. Ex. 3 | Comp. Ex. 4 | Ex. 9 | Ex. 10 | Ex. 11 |
|---|---|---|---|---|---|---|---|
| Toner No. | | | 11 | 12 | 13 | 14 | 15 |
| Amount (parts by mass) | polyester resin | RN290 | 15.8 | 15.8 | 15.8 | 73.7 | 15.8 |
| | | RN263 | 78.9 | 78.9 | 78.9 | 21.0 | 78.9 |
| | | RN289 | | | | | |
| | | EXL-101 | | | | | |
| | | RN-306 | | | | | |
| | | RSE-825 | | | | | |
| | carnauba wax | WA-05 | 5.3 | 5.3 | 5.3 | 5.3 | 5.3 |
| | Solvent Red 49 | ROB-B | | | 1.5 | 1.5 | 1.5 |
| | another colorant | OP312 | 1.0 | | | | |
| | another colorant | Seikalight Rose R40 | | 1.0 | | | |
| | Pigment Yellow 101 | S0795 | 0.5 | 0.5 | 0 | 0.25 | |
| | yellow colorant | OY106 | | | | | 0.5 |
| | silica for internal addition | HDK2000 | 3.0 | 3.0 | 3.0 | 3.0 | 3.0 |
| Evaluation results | | acid value of toner (mgKOH/g) | 9.5 | 9.5 | 9.5 | 27.2 | 9.5 |
| | | fluorescence ΔL* | 1.8 | 1.7 | 2.0 | 4.9 | 2.1 |
| | | high -temperature high-humidity resistant storage stability | A | A | B/C | B | C |

It was found that the toners of Examples realized fluorescence and practicability that could not be achieved by process colors known in the art. On the other hand, the toners of Comparative Examples had insufficient fluorescence (Comparative Examples 1, 3, and 4) and insufficient high-temperature and high-humidity resistant storage stability (Comparative Example 2) and the toners of Comparative Examples had inferior properties compared to the toners of Examples.

For example, embodiments of the present disclosure are as follows.

<1> A toner including:

a binder resin; and a colorant, wherein the colorant includes Solvent Red 49, and an acid value of the toner is 9.0 mgKOH/g or greater but 30.0 mgKOH/g or less.

<2> The toner according to <1>, wherein the colorant includes Pigment Yellow 101 in addition to Solvent Red 49.

<3> The toner according to <1> or <2>, wherein the binder resin includes a resin having a chloroform-insoluble component and an acid value of the resin having a chloroform-insoluble component is 20 mgKOH/g or greater but 40 mgKOH/g or less.

<4> The toner according to any one of <1> to <3>, wherein the toner includes inorganic particles for internal addition.

<5> The toner according to any one of <1> to <4>, wherein the toner includes a release agent, and an amount of Solvent Red 49 is from 0.5 percent by mass through 2.0 percent by mass relative to a total amount of the binder resin and the release agent in the toner.

<6> The toner according to any one of <2> to <5>, wherein the toner includes a release agent, and an amount of Pigment Yellow 101 is from 0.1 percent by mass through 0.5 percent by mass relative to a total amount of the binder resin and the release agent in the toner.

<7> A toner stored unit including:

the toner according to any one of <1> to <6> stored in the toner stored unit.

<8> An image forming apparatus including:

an electrostatic latent image bearer;

an electrostatic latent image forming unit configured to form an electrostatic latent image on the electrostatic latent image bearer;

a developing unit storing a toner and configured to develop the electrostatic latent image formed on the electrostatic latent image bearer with the toner to form a toner image;

a transferring unit configured to transfer the toner image formed on the electrostatic latent image bearer to a surface of a recording medium; and a fixing unit configured to fix the toner image transferred to the surface of the recording medium, wherein the toner is the toner according to any one of <1> to <6>.

<9> An image forming method including: forming an electrostatic latent image on an electrostatic latent image bearer; developing the electrostatic latent image formed on the electrostatic latent image bearer with a toner to form a toner image;

transferring the toner image formed on the electrostatic latent image bearer to a surface of a recording medium; and fixing the toner image transferred to the surface of the recording medium, wherein the toner is the toner according to any one of <1> to <6>.

The toner according to any one of <1> to <6>, the toner stored unit according to <7>, the image forming apparatus according to <8>, and the image forming method according to <9> can solve the above-described various problems in the art and can achieve the object of the present disclosure.

INDUSTRIAL APPLICABILITY

The toner of the present disclosure is preferably used for image formation of electrophotography, electrostatic recording, electrostatic printing, etc.

The invention claimed is:

1. A toner comprising:

a binder resin; and a colorant, wherein the colorant includes Solvent Red 49, and an acid value of the toner is 9.0 mgKOH/g or greater but 30.0 mgKOH/g or less.

2. The toner according to claim 1, wherein the colorant includes Pigment Yellow 101 in addition to Solvent Red 49.

3. The toner according to claim 2, wherein the toner includes a release agent, and an amount of Pigment Yellow 101 is from 0.1 percent by mass through 0.5 percent by mass relative to a total amount of the binder resin and the release agent in the toner.

4. The toner according to claim 1, wherein the binder resin includes a resin having a chloroform-insoluble component and an acid value of the resin having a chloroform-insoluble component is 20 mgKOH/g or greater but 40 mgKOH/g or less.

5. The toner according to claim 1, wherein the toner includes inorganic particles for internal addition.

6. The toner according to claim 1, wherein the toner includes a release agent, and an amount of Solvent Red 49 is from 0.5 percent by mass through 2.0 percent by mass relative to a total amount of the binder resin and the release agent in the toner.

7. A toner stored unit comprising:

the toner according to claim 1 stored in the toner stored unit.

8. An image forming apparatus comprising:

an electrostatic latent image bearer;

an electrostatic latent image forming unit configured to form an electrostatic latent image on the electrostatic latent image bearer;

a developing unit storing a toner and configured to develop the electrostatic latent image formed on the electrostatic latent image bearer with the toner to form a toner image;

a transferring unit configured to transfer the toner image formed on the electrostatic latent image bearer to a surface of a recording medium; and a fixing unit configured to fix the toner image transferred to the surface of the recording medium, wherein the toner is the toner according to claim 1.

9. An image forming method comprising:

forming an electrostatic latent image on an electrostatic latent image bearer;

developing the electrostatic latent image formed on the electrostatic latent image bearer with a toner to form a toner image;

transferring the toner image formed on the electrostatic latent image bearer to a surface of a recording medium; and fixing the toner image transferred to the surface of the recording medium, wherein the toner is the toner according to claim 1.

* * * * *